US010513874B2

(12) United States Patent
Fazi et al.

(10) Patent No.: US 10,513,874 B2
(45) Date of Patent: Dec. 24, 2019

(54) LOCK ASSEMBLY

(71) Applicant: Dometic Sweden AB, Solna (SE)

(72) Inventors: Mark R. Fazi, Osceola, IN (US); Robert C. Steffens, Stevensville, MI (US)

(73) Assignee: Dometic Sweden AB, Solna (SE)

( * ) Notice: Subject to any disclaimer, the term of this patent is extended or adjusted under 35 U.S.C. 154(b) by 485 days.

(21) Appl. No.: 15/184,499

(22) Filed: Jun. 16, 2016

(65) Prior Publication Data

US 2017/0362864 A1 Dec. 21, 2017

(51) Int. Cl.

| | |
|---|---|
| ***E05B 15/02*** | (2006.01) |
| ***E05B 65/00*** | (2006.01) |
| ***E05B 65/462*** | (2017.01) |
| ***E05C 1/06*** | (2006.01) |
| ***E05C 19/00*** | (2006.01) |
| ***E05C 7/00*** | (2006.01) |
| ***E05C 9/02*** | (2006.01) |
| ***E05B 41/00*** | (2006.01) |
| ***E05B 65/46*** | (2017.01) |
| ***F25D 23/02*** | (2006.01) |
| ***F25D 29/00*** | (2006.01) |

(52) U.S. Cl.

CPC ..... *E05C 9/028* (2013.01); *E05B 15/0205* (2013.01); *E05B 41/00* (2013.01); *E05B 65/005* (2013.01); *E05B 65/46* (2013.01); *E05B 65/462* (2013.01); *E05C 1/06* (2013.01); *E05C 7/00* (2013.01); *E05C 19/003* (2013.01); *F25D 23/028* (2013.01); *F25D 29/006* (2013.01); *E05B 2015/023* (2013.01)

(58) Field of Classification Search

CPC ... E05C 9/028; E05C 7/00; E05C 1/06; E05C 19/003; E05B 65/005; E05B 65/462; E05B 15/0205; E05B 2015/023

See application file for complete search history.

(56) References Cited

U.S. PATENT DOCUMENTS 1,840,163 A * 1/1932 Hersch ..... E05B 65/005 292/164
6,050,617 A * 4/2000 Prevot ..... E05B 63/0069 292/107

OTHER PUBLICATIONS

Transmittal Letter of Related Cases dated Jan. 17, 2017.
Chinese Patent Application No. 201610935578.5 entitled "Lock Assembly" filed Nov. 1, 2016.

* cited by examiner

*Primary Examiner* — Kristina R Fulton
*Assistant Examiner* — Thomas L Neubauer
(74) *Attorney, Agent, or Firm* — Middleton Reutlinger

(57) ABSTRACT

A lock assembly is provided which may be used for instance with mobile mounted appliances and cabinets. The lock assembly is provided to inhibit opening of the doors or drawers and which also shifts the lock assembly so that the lock does not inhibit closure of the door or drawer. The lock assembly also provides visual indication of the status of the lock.

22 Claims, 10 Drawing Sheets

LOCK ASSEMBLY

CLAIM TO PRIORITY

None

BACKGROUND

1. Field of the Invention

Present embodiments generally relate to a lock assembly. More specifically, but without limitation, present embodiments relate to a lock assembly which may be used for doors or drawers in mobile mounted appliances or cabinets.

2. Description of the Related Art

Appliance locks are required for use in appliances and cabinets, which are mounted for use in mobile application, such as for non-limiting example, recreational vehicles (RV), aircraft or marine craft. Appliances should be able to lock so as not to open during operation or movement of the mobile device.

Currently, residential appliances are not manufactured with locks. Due to this lack of locking capability, the appliances are not suitable for use in mobile applications such as RV or marine use.

Further, when approaching an appliance, one cannot always determine immediately whether the appliance is locked in a closed position or not. When trying to open a locked appliance, a user pulls the door or drawer open and reaches a hard stop which can be painful. This is undesirable.

It would be desirable to provide an appliance which may be used to retrofit residential appliances or may be installed at time of manufacture. Further it would be desirable to provide locking capability for both drawers and doors.

Likewise, it would be desirable to provide a lock assembly which clearly notifies a user when the appliance is either locked or unlocked.

Still further, it would be desirable to provide a lock assembly which moves to an unlocked position upon closing of the door or drawer so that a manual movement of the lock assembly is not required by a user.

The information included in this Background section of the specification, including any references cited herein and any description or discussion thereof, is included for technical reference purposes only and is not to be regarded subject matter by which the scope of the invention is to be bound.

SUMMARY

Present embodiments provide an appliance lock assembly. The assembly may be used with a plurality of appliances to lock in a closed position either doors or drawered for appliances or cabinets. The lock assembly provides a position which is mounted to movable portions of the appliance and further provides optionally to engage a structure on the fixed portion of the appliance. The lock assembly may also visually notify a user whether the lock assembly is in a locked or unlocked position.

According to some embodiments, a lock assembly may include a support configured to be mounted on an appliance or cabinet, a slide may have a body which is slidably positioned relative to the support and may be movable between a first position and a second position. A handle may be movable to direct movement of the slide. An anchor may have a receiving area which receives the slide to lock the slide and at least one striker surface which displaces the slide from one of the first and second positions to the other of the first and second positions before the door is closed.

Optionally, the lock assembly may be configured to be mounted between at least one door and one drawer. Alternatively, the lock assembly may be configured to be mounted between two drawers. Still further, the lock assembly may be configured to be mounted between two doors. The handle may be pivotally connected to one the said slide or the support. The handle may disengage the slide from the anchor to open the appliance or cabinet. The support may capture at least one of the slide and the handle. The lock assembly may further comprise a lock bracket which is engaged by the slide.

According to some embodiments, a lock assembly may include a support having a space for sliding movement. A slide may be disposed adjacent to the support, the slide may be movable between a first position and a second position relative to the support. A handle may captures the slide against the support, the handle may be pivotally mounted to the support to move the slide linearly between the first position and the second position. An anchor may be disposed opposite the support for engagement with the slide to move the slide upon engagement therewith.

Optionally, the anchor may have at least one angled surface to engage the slide and move the slide to an unlocked position. The handle may have a first engaging part and the slide may have a second engaging part which engages the first engaging part. The first engaging part may be one of a male part or a female part and the second engaging part may be the other of a male part or a female part. The male and female parts may have an interference engagement to move beyond a preselected position. The handle may have an indicator for an unlocked condition and an indicator for a locked condition. The support may be positioned below at least one of the slide and the handle. The lock assembly may further comprise a lock bracket positioned adjacent to a path of the slide. The lock bracket may be disposed on a fixed portion of an appliance. The anchor may be disposed on a movable portion of the appliance. The support may be mounted to one of a movable portion or a fixed portion of the appliance. The anchor may be mounted to the movable portion of the appliance. The lock assembly may further comprise a lock bracket which is mounted to the one of the fixed portion or the movable portion of the appliance.

According to some embodiments, a lock assembly may include a support configured to be mounted on an appliance or cabinet, the support having a plurality of pads which are spaced apart. A slide may having a body which is slidably engaging the support and movable between a first position and a second position. A handle may be connected to the support and movably engaging the slide to direct movement of the slide. An anchor may have a receiving area which receives the slide to lock the slide and at least one striker surface which displaces the slide from one of the first and second positions to the other of the first and second positions before the door is closed. A lock bracket may receive a finger extending from the support.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments might be better understood, embodiments of an appliance lock assembly will now be described by way of example. These embodiments are not intended to limit the scope of the claims, as other embodiments of the appliance lock assembly will become apparent to one having ordinary skill in the art upon reading the instant description, including but not limited to combinations of features and/or embodiments not expressly shown. Non-limiting examples of the present embodiments are shown in figures wherein:

DETAILED DESCRIPTION

Figure 1:
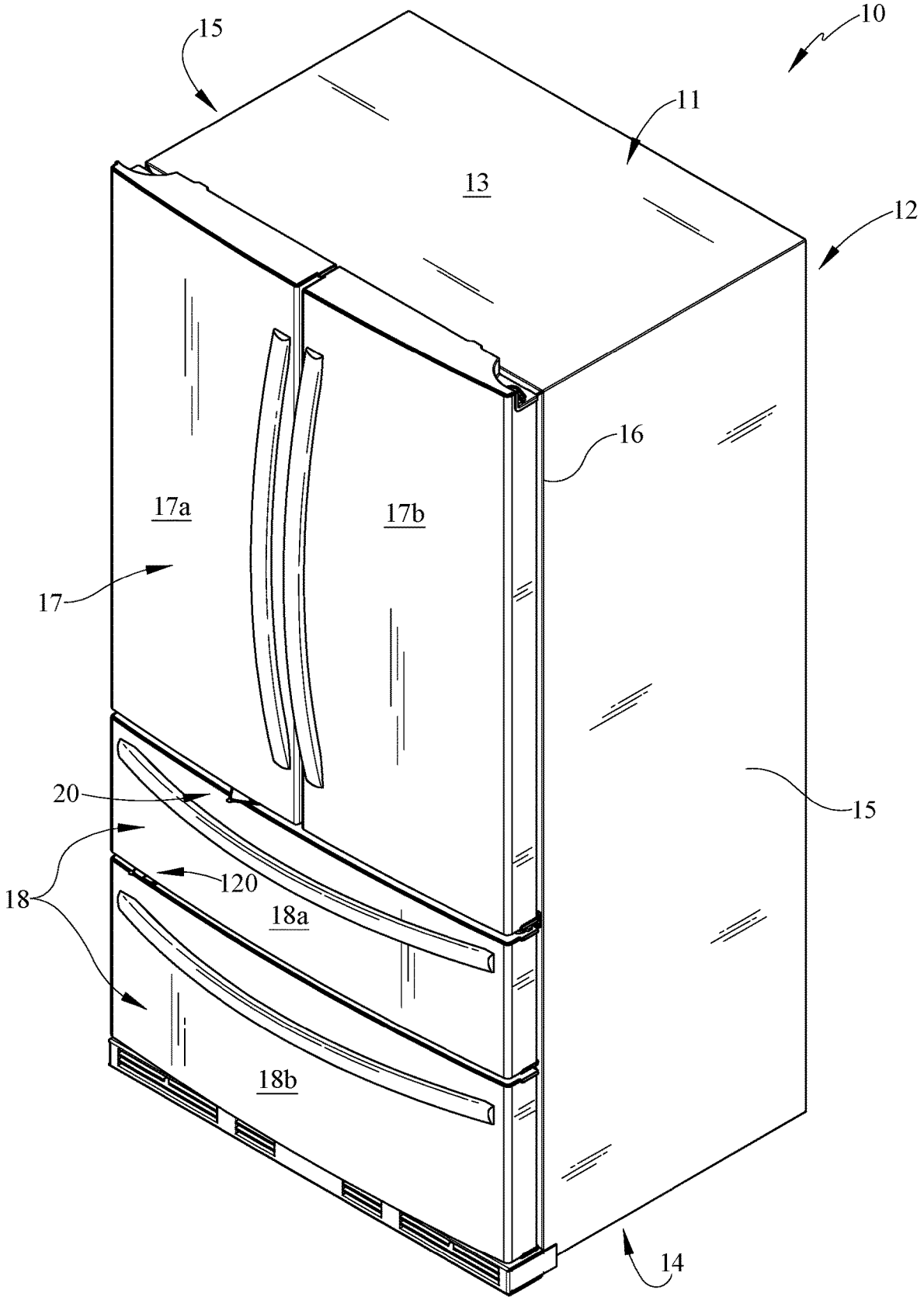
FIG. 1 is a perspective view of a non-limiting example of an appliance.

It is to be understood that the appliance lock assembly is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the Figures, wherein like numerals indicate like elements throughout the several views, there are shown in FIGS. 1 through 10 various embodiments of an appliance lock assembly are shown. The lock assembly may be used on various appliances or cabinets, including but not limited to a refrigerator as shown in at least one instant embodiment. The appliance lock assembly may be configured for use with any of various appliances, including but not limited to dishwashers, ovens, microwaves, and kitchen, bathroom or other cabinets to lock doors or drawers in a closed position, or alternatively to allow opening. Further, the lock assembly may also provide for structure moving a locking feature toward an unlocked position during a closing motion so that the lock assembly with properly close without requiring manual manipulation of the lock assembly to close the appliance door or drawer.

Referring now to FIG. 1, a perspective view of a non-limiting example of an appliance 10 is shown. The appliance 10 in the embodiment depicted is a refrigerator 11. However, the appliance 10 may be a plurality of appliances which have either a door, a drawer or other opening and closing feature which is desired to be closed and locked for operation in a recreational vehicle (RV) or other mobile application. Further, it should be understood that according to some embodiments, it may be desirable to utilize a standard appliance which is typically used in a fixed structure, such as a residential home, apartment or generally fixed structure, business building or other non-moving structure and make such appliance 10 available for use in an RV or marine vehicle. The present locking assemblies 20, 120 will provide for such possibility by way of retrofit or may be installed at time of manufacture of the appliance or cabinet.

The appliance 10 may comprise a housing 12 having a plurality of walls, for example a top wall 13, a bottom wall 14, and sidewalls 15. The housing 12 may define a cabinet 16 or in other embodiments a cabinet 16 may be inserted into the housing 12. The cabinet 16 may define one or more compartments (not shown) for temperature controlled food storage according to some embodiments. Other uses may be provided. As will be described further, the term "cabinet" is used with regard to the appliance but generally refers also to cabinets of typical construction for storage of plates, utensils and canned or other non-temperature controlled food storage.

The housing 12 surrounds the appliance 10 except for one side. In the front, one or more doors 17 or drawers 18 may be utilized to enclose the housing 12. According to the exemplary embodiment, the appliance 10 includes a French door arrangement of doors 17*a*, 17*b*, generally 17, and two drawers 18*a*, 18*b*, generally 18, under the doors 17*a*, 17*b*. Other arrangements and configurations may be utilized and therefore the depicted embodiment is merely for purpose of explanation but is not limiting.

Figure 2:
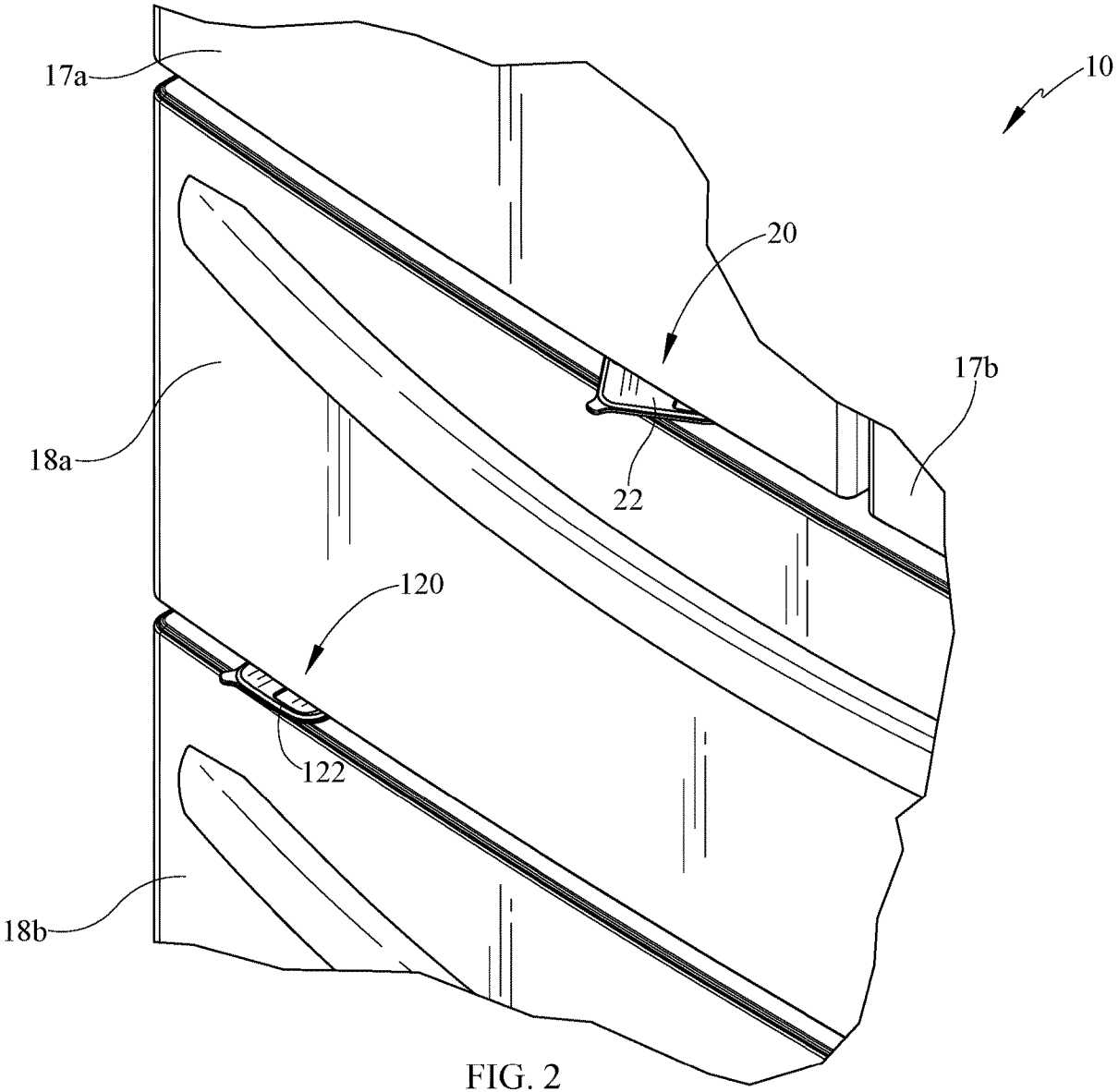
FIG. 2 is a perspective view of the appliance of FIG. 1 with a portion of the appliance lock assemblies.

Referring now to FIG. 2, a perspective view of the appliance 10 is shown in a more detailed view than that of FIG. 1. In the instant view, a first lock assembly 20 is shown for locking the doors 17*a*, 17*b*. Likewise, a second lock assembly 120 is shown between the drawers 18*a*, 18*b*. The lock assembly 20 may be utilized to lock the doors 17*a*, 17*b* in a closed position. Further, the lock assembly 120 may be formed to maintain the drawer 18*a* in a closed position in addition to or alternatively to the two doors above. Still further, the lock assemblies 20, 120 may be configured to maintain one or both drawers 18*a*, 18*b* in a closed position or a combination of door(s) and drawer(s).

In the depicted embodiment, the lock assemblies 20, 120 each have a handle 22, 122, respectively. The handles 22, 122 may be used by a user to lock and unlock the lock assemblies 20, 120. In this embodiment, the handles 22, 122 are the only portion of the assemblies which are easily seen from the exterior of the appliance 10, when the doors 17 or drawers 18 are closed. As will be described further, the lock assemblies 20, 120 may have visual indicators to easily determine whether the lock assemblies 20, 120 are either locked or unlocked.

Each of the handles 22, 122 are movable between a first position wherein the assemblies are locked and a second position wherein the assemblies are unlocked. Various movements are possible. In some embodiments, the handle 22, 122 may slide linearly. In other embodiments, the handles 22, 122 may have a rotational movement. In other embodiments, the movement of the handles 22, 122 may be a combination thereof or some other movement sequence.

Figure 3:
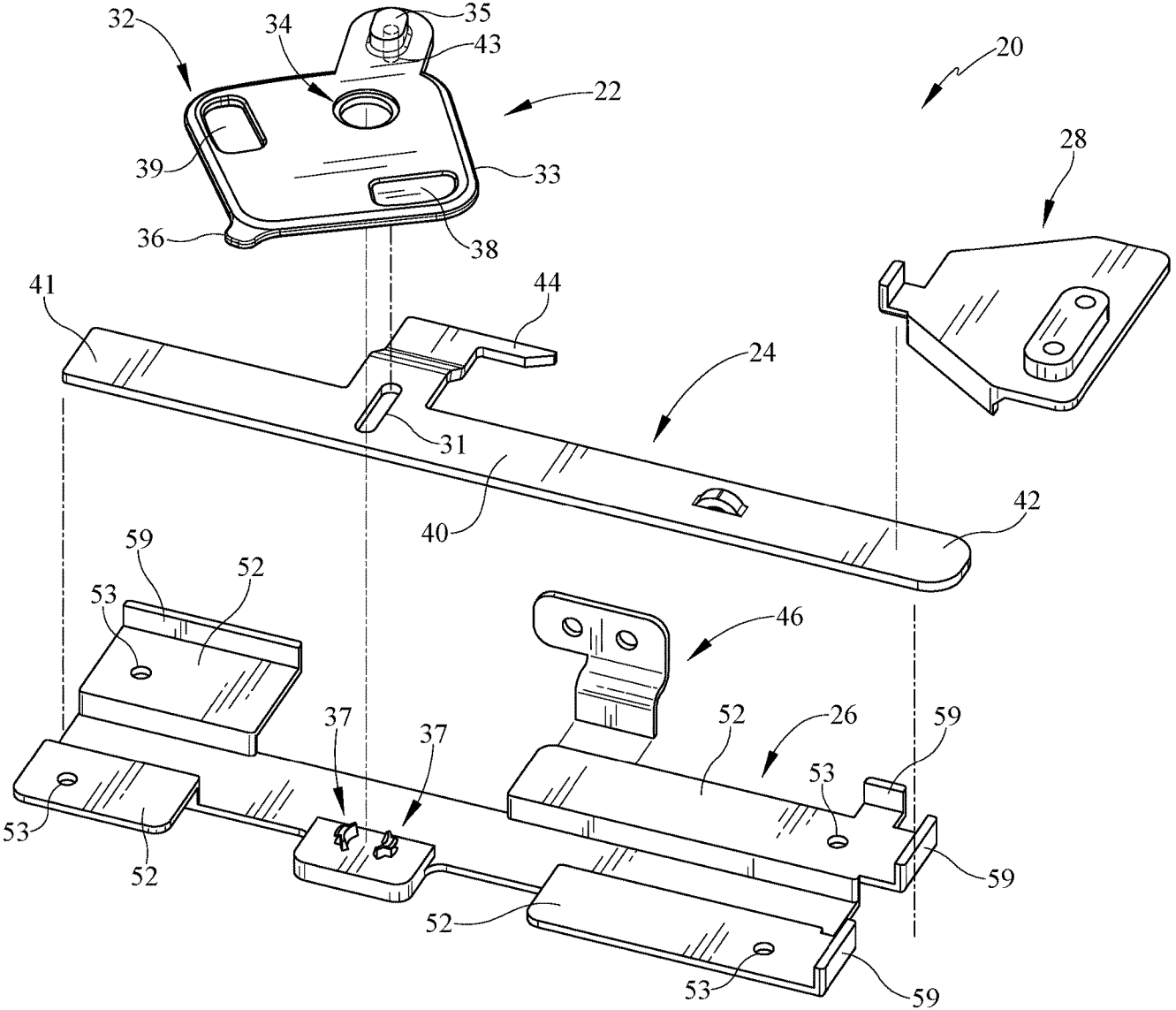
FIG. 3 is a exploded perspective view of one embodiment of an appliance lock assembly.

Referring now to FIG. 3, an exploded perspective view of the lock assembly 20 is shown. According to some embodiments, the lock assembly 20 comprises the handle 22, a slide 24, a support 26 and an anchor 28. The slide 24 is positioned to move within or at least relative to the support 26 and engages the anchor 28. The slide 24 is moveable between at least a first position and a second position wherein at least one of the positions is a locked position and wherein at least one of the positions is an unlocked position.

With reference to FIGS. 2 and 3, the handle 22 may extend from between a small gap in the appliance 10 door 17 and/or drawers 18. The lock assembly 20 is designed to fit within a small height tolerance opening so that the lock assembly 20 may be designed to be retrofit to existing appliances or may be incorporated at time of manufacture of the appliance. Further, the lock assembly 20 may render a residential appliance usable in a mobile application. As shown in FIG. 2, the handles 22, 122 can extend forward of the front surface of the refrigerator to aid in use by the user. A portion of the handles 22, 122 may be grasped by the user to move the lock assembly 20, 120 from a locked to unlocked position or vice-versa.

Referring again to FIG. 3, the handle 22 may have a geometric shape, in some non-limiting embodiments for example generally square shaped. The handle 22 may be formed of various other shapes, regular or irregular, however, and includes at least one side 32 defining a perimeter 33. Within the perimeter 33 of the handle 22 is at least one pivot structure 34. For example the handle 22 may include pivot structure 34 embodied for non-limiting example, by an aperture through which a snap structure 37 extends. The handle 22 can pivot about the pivot structure 34 by way of a user grasping or urging a tab 36. Application of force to the tab 36 causes pivoting of the handle 22 about the pivot structure 34. In other embodiments, however, the pivot structure 34 may be located on the support 26 and snap structures 37 located on the handle 22 in a reverse configuration from that which is depicted. In still other embodiments, one or more additional parts may be provided to join the handle 22 and the support 26 and provide the movable functionality.

Additionally, the handle 22 may include at least one indicator 38 to provide indication of at least one condition. For example, the indicator may correspond to at least one of a first position, such as a locked position or a second position such as an unlocked position. In some embodiments, the handle 22 may include two indicators 38, 39, one for locked position and one for unlocked. With reference briefly additionally to FIG. 2, the only indicator which may be visible may be related to the position of the handle relative to the appliance 10. Otherwise stated, when unlocked, only the unlocked indicator 39 may be visible, whereas alternatively when locked, only the locked indicator 38 may be visible.

Optionally, the handle 22 may also have a boss 35 which limits floating or other variation of elevation of the handle 22 during rotation. The boss 35 accommodates for any height differential between a lower surface of the appliance 10 and the upper surface of the handle 22. Where the bottom surface of the appliance 10, where the handle 22 is mounted is flat, there may be no need for the boss 35. Alternatively, where the lower surface of the appliance 10 has a depression or recess, the boss 35 may accommodate the height difference between the appliance 10 and the lock assembly handle 22 created by the depression.

Referring still to FIG. 3, the exploded perspective view also depicts a slide 24. The handle 22 rotates about pivot structure 34 and causes motion of the slide 24. The slide 24 has an elongated body 40 having a first end 41 and a second end 42. One of the first and second ends 41, 42 may be movable within and/or relative to a support 26 to maintain the slide 24 in a desired position. The other of the first and second ends 41, 42 may engage an anchor 28 which causes the appliance 10 to be locked closed. The corners of the slide 24 are shown as rounded to aid entry into an anchor 28. However in some embodiments, the shape may change, such as for example to a tapered shape to further aid entry into the anchor 28. Still further, other embodiments may be used to engage the anchor 28 such as, for example, a hook or other catch or engagement feature which may engage with a corresponding feature in or on the anchor 28.

The handle 22 and the slide 24 may be engaged by a number of engaging parts, including but not limited to male and female parts. In some embodiments, a pin 43 may extend from the handle and engage a slot 31 in the body 40. Optionally, the instant embodiment uses such structural arrangement to provide an over-center interference which result in an interference near the center of movement of the handle 22 or the slide 24 motion. This in turn requires an additional force input by the user to continue motion of the handle 22 and slide 24. In other embodiments the slot 31 and pin 43 may be reversed. Further, other engagement structures may be used to provide movement of the slide 24 when the handle 22 moves.

In the depicted embodiment, the slot 31 is substantially perpendicular to a longitudinal direction generally extending between the first and second ends 41, 42. However, the slot 31 may also be oriented at some angle to the longitudinal direction which is other than perpendicular in order to vary the distance and/or direction of travel of the slide 24.

Extending from the body 40 is a locking finger 44. During sliding motion of the slide 24, the locking finger 44 may engage a lock bracket 46. The lock assembly 20 may be mounted to a moving portion of the appliance 10, such as a door or drawer, and the lock bracket 46 portion of the lock assembly 20 may be positioned on a fixed portion of the appliance 10. In this way, the lock bracket 46 forms a fixed mount to also inhibit opening of the appliance door or drawer when the appliance 10 is locked. The lock finger 44 may be fixed at an elevation or may vary in elevation by having one or more bends in order to engage the lock bracket 46. Further, the end of the finger 44 is tapered to aid in aligning the finger 44 with a lock bracket 46. However, other shapes may be utilized to either align or otherwise engage the finger 44 with the lock bracket 46.

In present embodiments, when assembled, the lock bracket 46 is oriented to receive a horizontal movement of finger 44. However, in other embodiments, the lock bracket 46 may be configured to receive a vertical motion of the finger 44. Still further, the lock bracket 46 could have an alternate shape which is engaged by a hook or catch formed on the lock finger 44 which moves either horizontally or vertically. In further optional embodiments, the lock bracket 46 may be mounted on a movable portion of the appliance 10 with, for example, the support 26 while an anchor 28 is mounted to a fixed portion of the appliance 10.

Referring still to FIG. 3, the support 26 is also shown. The support 26 may be a variety of shapes which may include a generally longitudinal direction related to the shape of the slide 24. The support 26 allows for sliding motion of the slide 24 and movement of the finger 44 at least therethrough in part. The support 26 captures at least one of the slide 24 and the handle 22 to the appliance 10 (FIG. 1). With reference to FIG. 2, briefly, as will be understood, the support 26 mounts to the bottom surface of the refrigerator door 17*a*. However, it should be considered within the scope of the present embodiments that the support 26 and lock assembly 20 may be mounted along a top surface or a vertical side surface of a door. Likewise the lock assembly 120 described further herein may be positioned at alternate locations than that shown in the figures, as such is merely one non-limiting example. Above the support 26 is the handle 22 and the slide 24, which moves within and relative to the support 26.

The support 26 includes a plurality of mounting pads 52. The mounting pads 52 may include one or more fastener apertures 53 to fasten the support 26 to a surface of a door 17 or drawer 18. Further, the pads 52 are elevated from a lowermost surface of the support 26. In this way, when viewed from ends, the handle 22 and the slide 24 are lower than the pads 52 providing a clearance for movement of the handle 22 and slide 24 between the support 26 and the appliance 10.

Near edges of the support pads 52, may be locating features 59, to properly locate the support 26 relative to the edges of the appliance doors or drawers. The locating features 59 are shown as walls which engage edges of appliance or cabinet doors or drawers. However, other structures may be used to locate the support 26 for example which may cooperate with structures on the appliance 10. For example, bosses, pins or other structures may be utilized to engage a corresponding part or portion of a part with the support 26. Still further, the features need not be located relative to an edge but may also locate the support 26 relative to a hole or other feature spaced from an edge of the door or drawer. Still further, while the locating features are shown extending from the support 26, the support 26 may alternatively comprise apertures which receive a male feature extending from the appliance or cabinet door or drawer.

To the right hand side of the figure is an anchor 28. In order to lock the lock assembly 20, the slide 24 is moved to engage the anchor 28. Alternatively, the slide 24 is moved away from the anchor 28 to unlock the assembly 20. The anchor 28 may be used alone or may be used with the lock bracket 46 previously described to inhibit opening of the appliance 10 door 17 and/or drawers 18.

Figure 4:
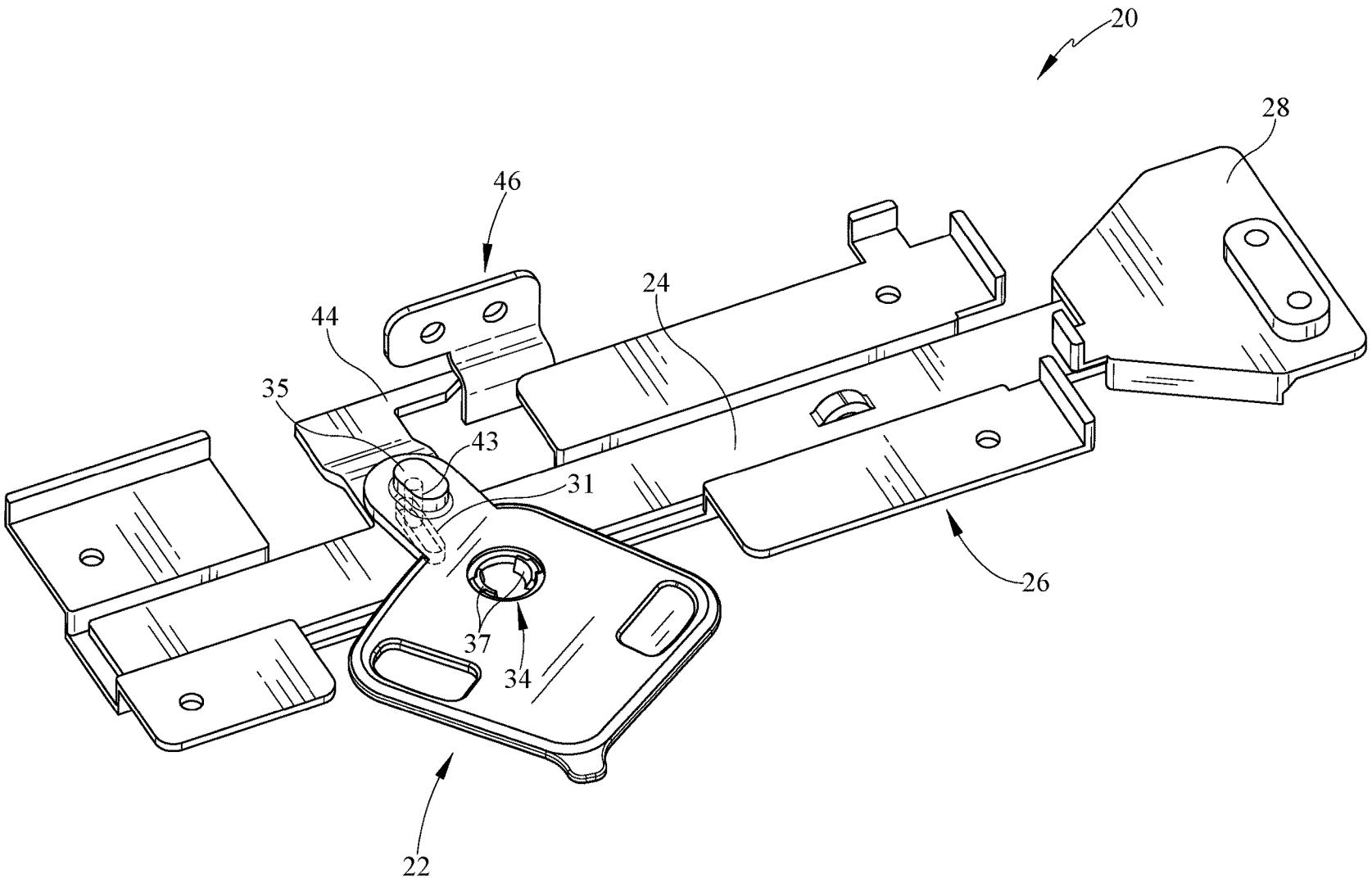
FIG. 4 is an upper perspective assembly view of the appliance lock assembly.

Referring now to FIG. 4, an upper perspective view of the lock assembly 20 is shown. In this view, the lock assembly 20 is assembled. In this view, the pivot structure 34 of the handle 22 is shown wherein two or more snap structures 37 are extending through the pivot structure 34. The snap structures 37 retain the handle 22 on the support 26 and further allow for pivoting or rotation of the handle 22 relative to the support 26. In some embodiments, the handle 22 may also or alternatively rotate relative to the slide 24 or may move linearly with or relative to the slide 24. Further, other structures may be used to provide the pivoting movement.

Further, with a small window shown through the boss 35, a pin 43 is shown depending from the handle 22 and through a slot 31 in the slide 24. Thus pivoting movement of the handle 22 actuates the linear motion of the slide 24 between the locked and unlocked positions. As the handle 22 rotates, the pin 43 moves within the slot 31 to move slide 24.

Also shown, the slide 24 is engaging the anchor 28. In this condition, the slide 24 inhibits movement due to engagement with anchor 28. Therefore one door cannot move relative to the opposite door.

Figure 5:
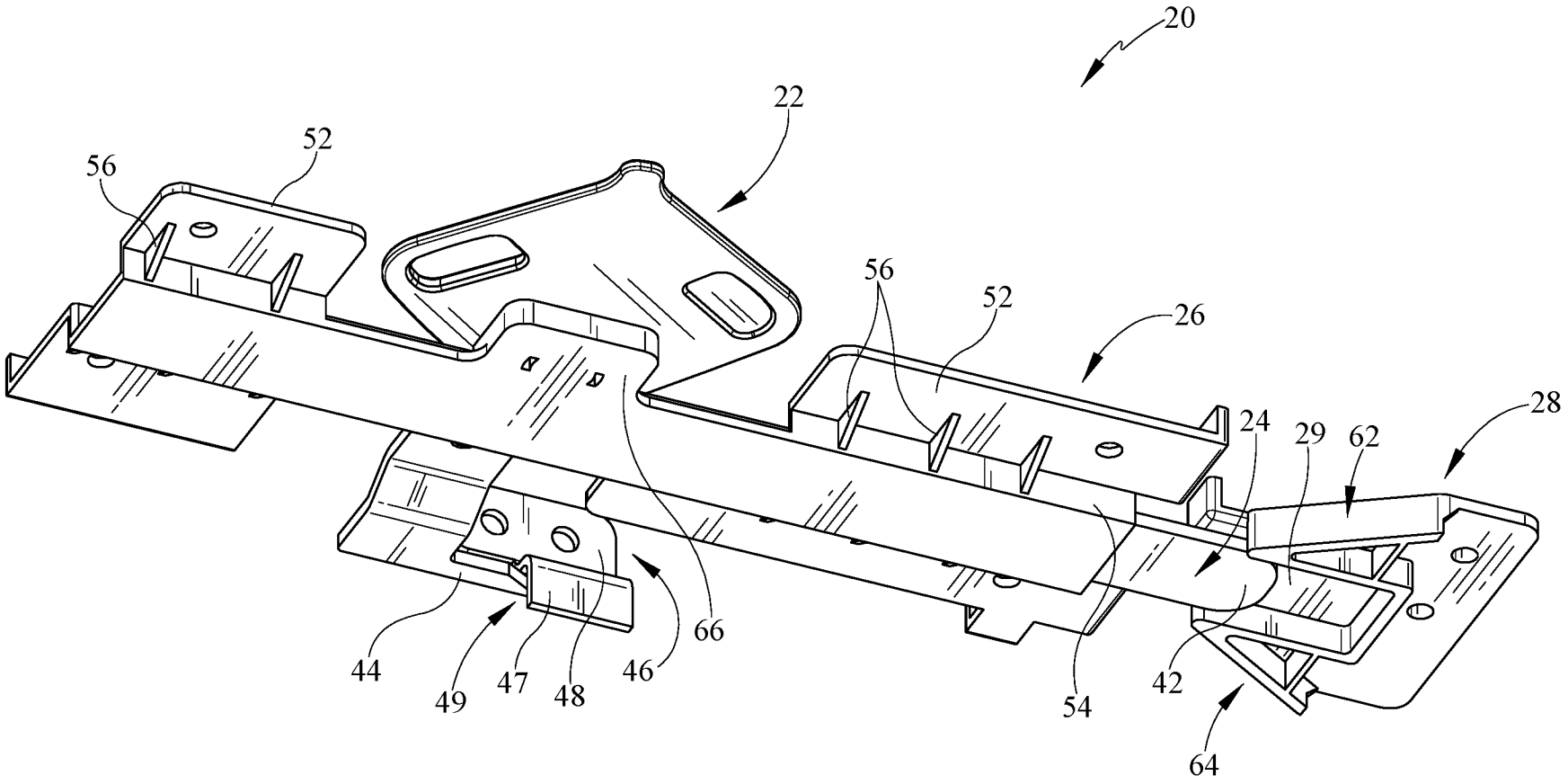
FIG. 5 is a lower perspective assembly view of the appliance lock assembly.

Referring now to FIG. 5, a lower perspective view of the lock assembly 20 is shown. In this view, the support 26 may be clearly shown. Each of the pads 52 is elevated relative to the lowermost surface of the support 26. The pads 52 are separated from the lowermost surfaces by risers 54. The risers 54 and pads 52 are supported with one or more brackets 56 along the length of the support 26. The risers 54 provide a clearance so that the slide 24 and the handle 22 can move despite being captured between the support 26 and the appliance 10 (FIG. 1).

Also shown in the lower perspective view is the anchor 28. The anchor 28 is mounted on a door opposite the door with the slide 24 or alternatively mounted on a drawer opposite to a position where the remainder of the lock assembly 20 is located. The anchor 28 includes a receiver area 29 which is channel shaped in cross section in some embodiments. One of the first and second ends 41, 42 slides into the receiver area 29. By connecting the two doors, for example, 17*a*, 17*b* with the slide 24 and anchor 28, the doors cannot open. Likewise, the slide 24, specifically the finger 44, may engage a lock bracket 46 to also fix either the doors 17 or drawers 18 relative to a fixed structure of the appliance or cabinet.

Also shown in this view is at least one striker surface 62. In the instant embodiment, the anchor 28 includes two striker surfaces 62, 64 so that the lock assembly 20 may be used toward a right hand side or a left hand side orientation. The striker surfaces 62, 64 are angled so that as the opposite door is closed, if the slide 24 is extended toward a locked position, the end of the slide 24 engages the striker surface 62 or 64. Due to the angle of the striker surface 62, the slide 24 is forced to retract so that the door can continue to close. Thus, the lock assembly 20 does not require an independent action of moving the slide 24, by way of handle 22 to an unlocked position, in order to close a door 17 or drawer 18. The slide 24 will move to allow closure of the doors 17 and drawers 18. The striker surface 62, 64 is shown as angled, but this should be understood to not be limited to merely a linearly extending surface but also include a curved, curvilinear or other shape to provide movement of the slide 24 upon engagement of the slide 24 with the striker surface 62.

Also shown extending from the support 26 and formed integrally therewith according to some embodiments is a pivot landing 66. Above the pivot landing 66 is the handle 22 and the pivot landing 66 provides a location to position the snap structures 37 (FIG. 4) and rotatable support the handle 22.

Also shown in FIG. 5 is the lock bracket 46. In the instant embodiment, the lock bracket 46 is connected to a fixed portion of the appliance 10. The lock bracket 46 has a catch 47 which is engaged by the finger 44. The catch 47 extends from the base 48 of the lock bracket 46 creating a space 49 wherein the finger 44 may engage the lock bracket 46.

When the finger 44 of the slide 24 engages the lock bracket 46, the slide 24 cannot move away from the fixed portion of the appliance 10. This in combination with the slide 24 engaging the anchor 28 provides two means of inhibiting the door or drawer from opening.

Figure 6:
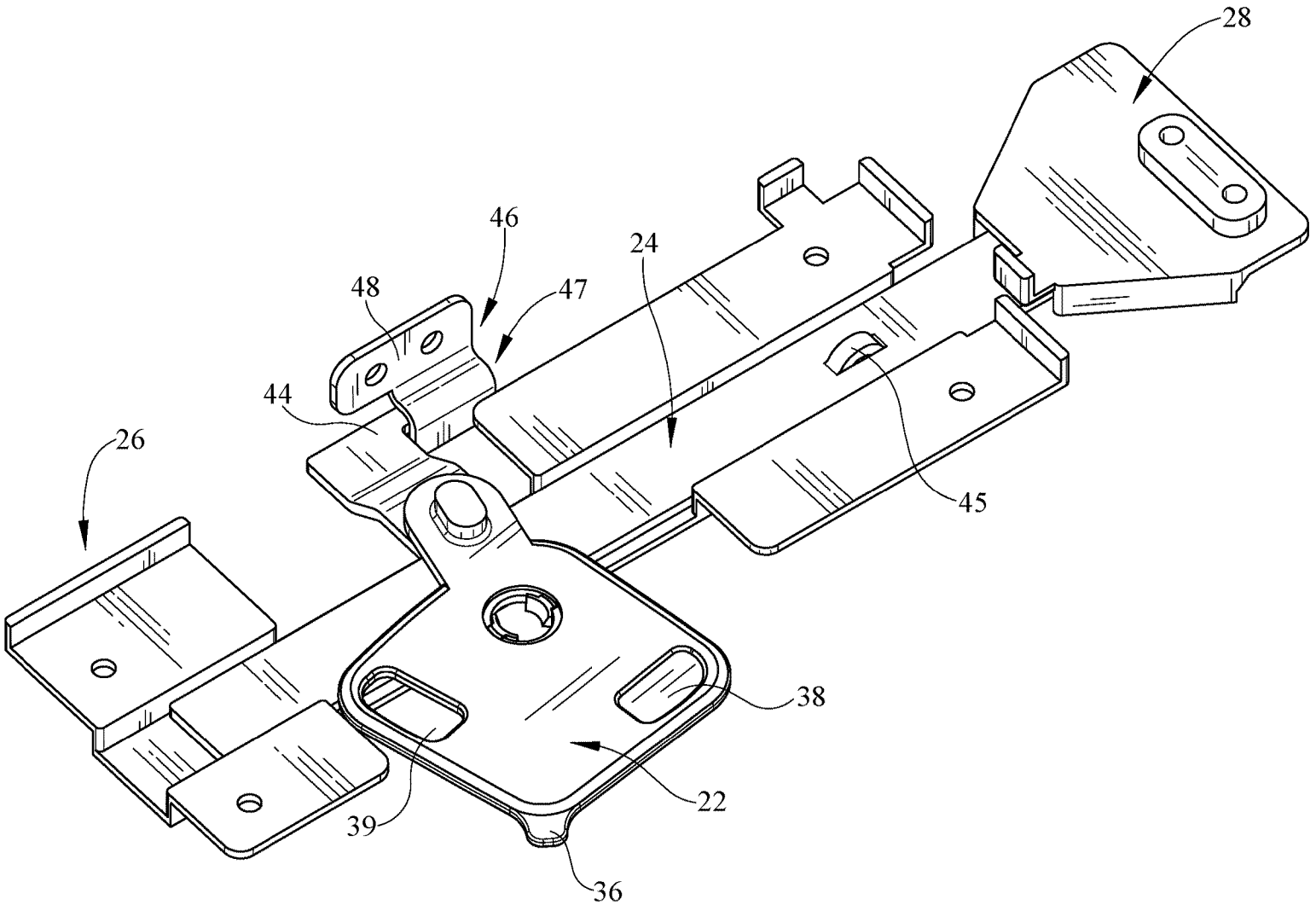
FIG. 6 is a first sequence view of the appliance lock assembly.
Figure 7:
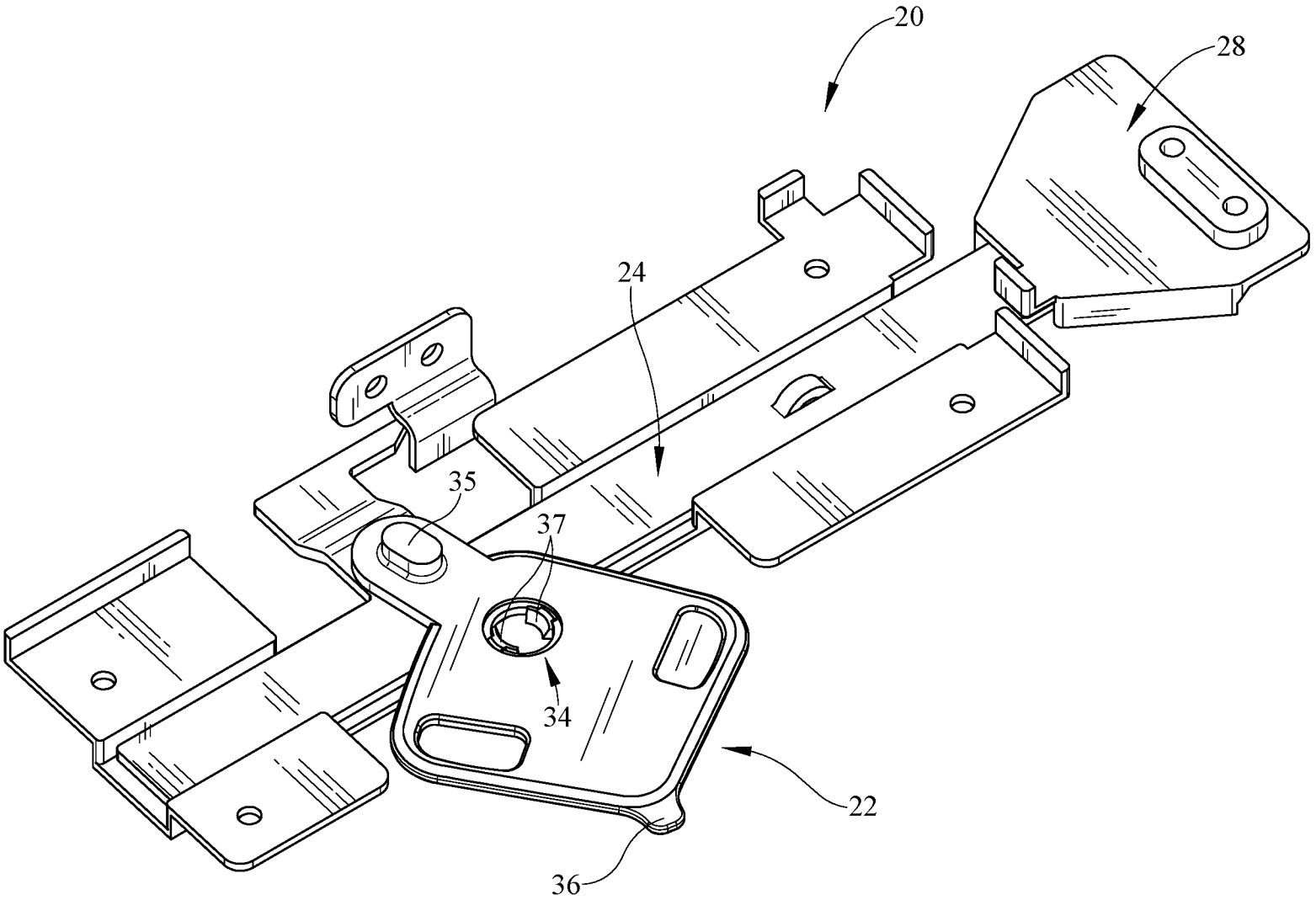
FIG. 7 is a second sequence view of the appliance lock assembly.
Figure 8:
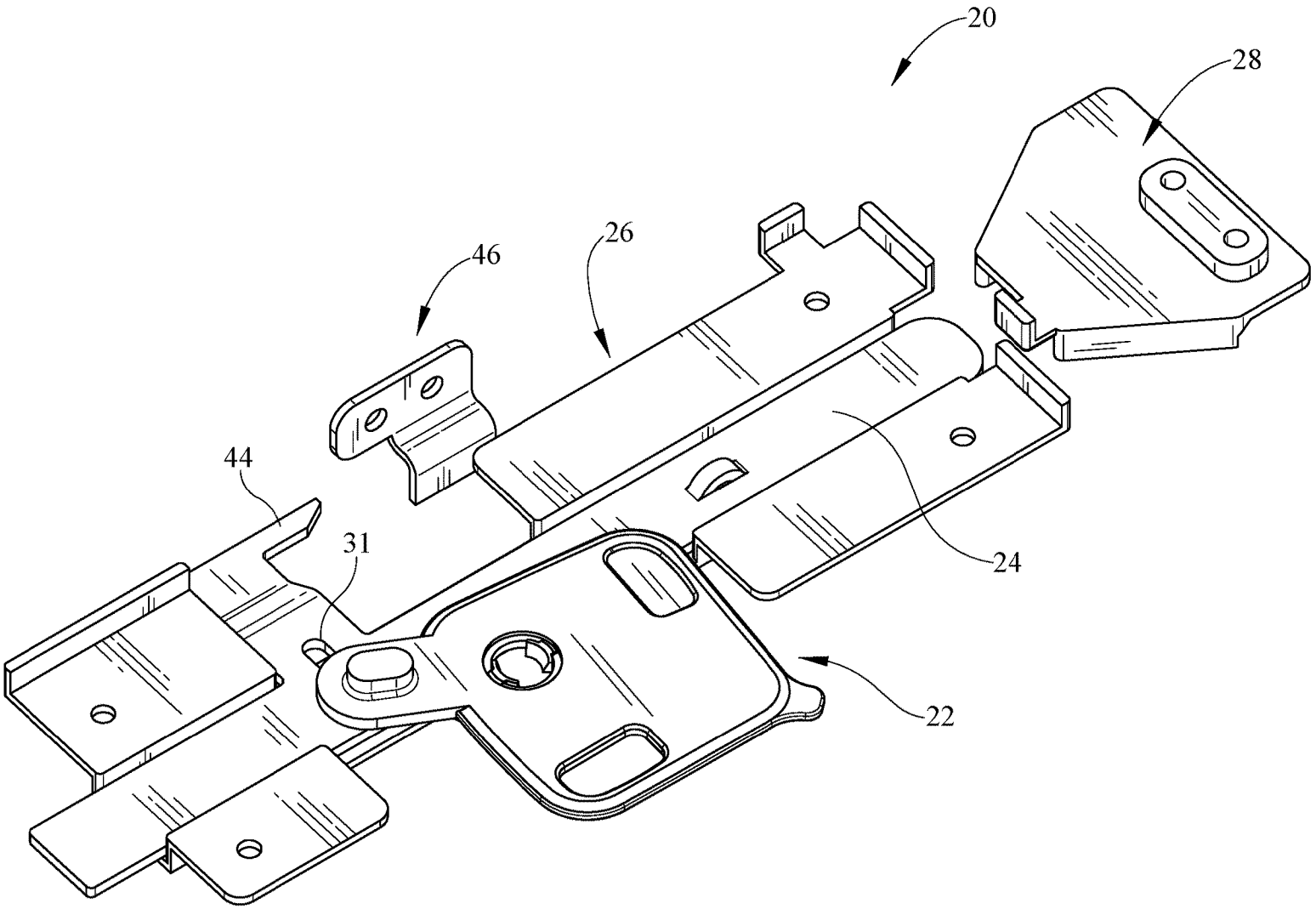
FIG. 8 is a third sequence view of the appliance lock assembly.

Referring now to FIGS. 6-8, a sequence of view is shown depicting the slide 24 and handle 22 moving from a locked position to an unlocked position. Referring first to FIG. 6, the handle 22 is shown pivoted toward a left most position which causes the slide 24 to extend to the right and engage the anchor 28. In this embodiment, and with additional reference to FIG. 2, the lock indicator 38 is exposed from the door 17 or drawer 18 of the appliance 10. In the instant embodiment, the lock indicator 38 is filled whereas the unlocked indicator 39 is an open hole. These are examples and should not be considered limiting of the only ways to indicate locked or unlocked positions. Also, the tab 36 is extending to the left side of the depicted image from the handle 22.

Further, toward the rear of the lock assembly 20, the finger 44 is shown engaging the lock bracket 46. The finger 44 as previously described adds a second manner of inhibiting movement of a door or drawer by connecting the movable portion of the lock assembly 20 to a fixed portion.

With brief reference to the slide 24, an anti-floating protuberance 45 is shown extending from the slide 24. The protuberance 45 limits vertical motion of the slide 24 relative to the support 26. The protuberance 45 will engage a lower surface of the appliance 10, to which the lock assembly 20 is connected during the sliding motion of the slide 24. The limits vertical movement of the slide 24.

With reference now to FIG. 7, the handle 22 is shown rotated about the pivot structure 34. In this view, the tab 36 is moving to the right and the slide 24 is moving left away from its position within the anchor 28. As this occurs, the handle 22 is pivoting about the snap structures 37 and the pivot structure 34. As this occurs, the slide 24 is depicted as moving to the left, away from anchor 28.

The boss 35 includes the pin 43 (FIG. 4) which extends into the slot 31 (FIG. 9) of the slide 24. While this is described and shown, other methods of engagement may be provided to move the handle 22 and cause movement of the slide 24. In the depicted position, which is generally a central position of the slide 24, the pin 43 may reach an interfering position of the slot 31 (FIG. 4). At this position, force on the tab 36 or the handle 22 may be increased in order to overcome the inference and continue moving the handle 22.

With reference now to FIG. 8, the handle 22 is moved further to the right, in the depicted view, so that the slide 24 is moved further to the left. In this position, the pin 43 (FIG. 4) and slot 31 interference has been overcome and the handle 22 has rotated further left. As a result, the slide 24 has moved again through the support 26 and further from the anchor 28. In the depicted position, the slide 24 is at a maximum extracted or unlocked position from the anchor 28. Further, the finger 44 is also shown fully removed from the lock bracket 46.

Figure 9:
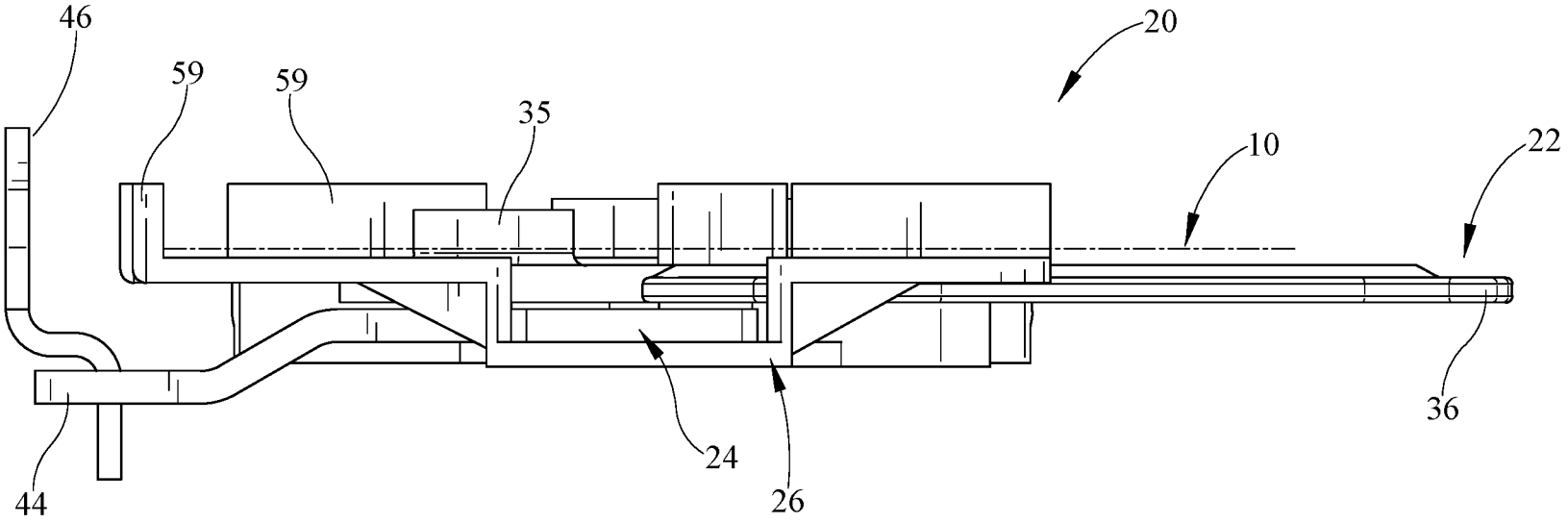
FIG. 9 is an end elevation of the appliance lock assembly.

With reference now to FIG. 9, an elevation view is provided viewing toward an end of the slide 24. The elevation view is helpful in depicting the low profile design of the lock assembly 20. In the depicted embodiments, the lock assembly 20 is designed to be retrofit to existing refrigerators or be installed at time of manufacture. The low profile form of the lock assembly 20 allows for the lock assembly 20 to be positioned between doors or drawers of the appliance 10. The appliance 10 is represented by a broken line and is shown elevated slightly from the support 26 (FIG. 8) merely for purpose of illustration and differentiating the two parts. In operation, the support 26 may be in contact with the appliance 10. Further, the locating features 59 of the support 26 locate the lock assembly 20 relative to the door 17 or drawer 18 of the appliance 10, shown representatively in broken line. The appliance 10 therefore functions in part as an upper bound for the lock assembly 20. As shown in this view, the boss 35 limits upward deflection in that the boss 35 will engage a lower surface of the appliance 10. However, while the boss 35 is shown above the elevation of the appliance surface in broken line, the boss 35 may be desirable where the adjacent surface of the appliance 10 is recessed. In such arrangement the boss 35 may take-up the difference by extending upward, into such recess. However, where the surface of the refrigerator is flat, there may not be a need for the boss 35.

Additionally, as shown in FIG. 9, the finger 44 is shown extending from the lock assembly 20. The finger 44 has a bend which allows for adjustment of the elevation level of the corresponding lock bracket 46 (FIG. 5).

The slide 24 is shown in a manner in which it moves into and out of the depicted figure during operation. Similarly, the finger 44 also moves into and out of the plane of the depicted figure during operation.

Figure 10:
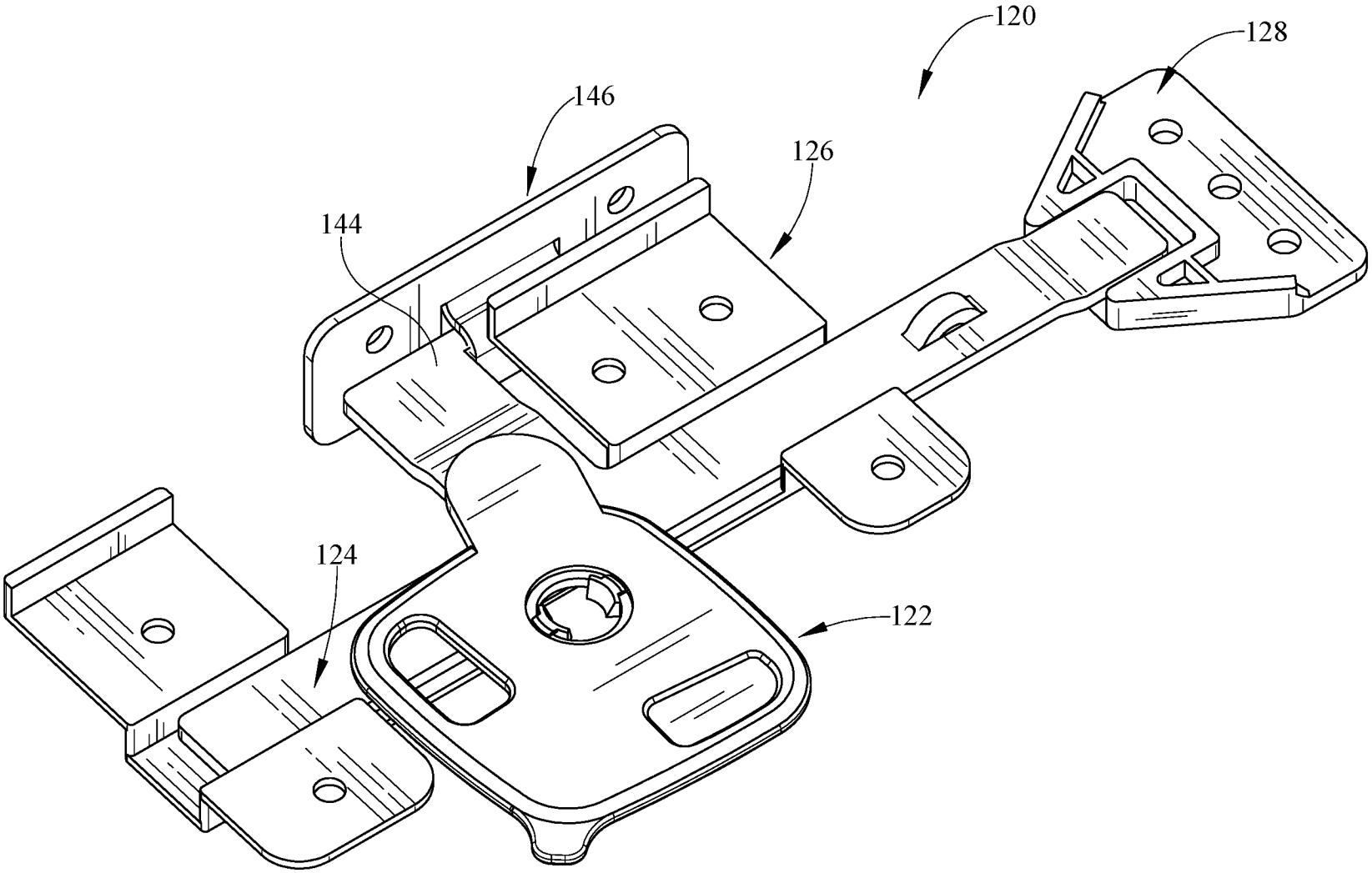
FIG. 10 is an upper perspective view of a second embodiment for use with an appliance drawer.

Referring now to FIG. 10, a perspective view of an alternate lock assembly 120. As shown in FIG. 2, this embodiment may be used between drawers to inhibit one or more drawers from opening. In alternate embodiments, for example a refrigerator with an upper door and a lower door, this embodiment may be positioned between the two doors.

In this embodiment, the support 126 may be connected to an upper drawer such as drawer 18*a* (FIG. 2) and the anchor 128 is connected to the lower drawer 18*b*. When the slide 124 moves into engagement with the anchor 128, the two drawers 18*a*, 18*b* are engaged to function together.

Further, the embodiment utilizes a lock bracket 146 which is engaged by finger 144. The lock bracket 146 is mounted to a fixed portion of the structure. When engaged by the finger 144, the support 126 cannot move away from the fixed portion of the appliance 10 (FIG. 1). Thus by locking the upper drawer 18*a* from opening away from the locking bracket 146, the slide 124 and anchor engagement 128 also preclude movement away from the appliance 10 as well.

Further worth noting in this embodiment, the handle 122 does not include the boss as in the previous embodiment. In this arrangement, the lower surface of the drawer 18*a* is flat and does not include a recess. Thus, the boss is not needed to accommodate the offset elevation due to any recess.

In the various embodiments, the support is shown connected to a movable portion of an appliance or cabinet, such as the door. However, as described, other embodiments are possible where, for example, the support may be mounted to a fixed portion of the appliance or cabinet. Further, the anchor may be mounted to a movable portion of the appliance or cabinet as shown in the embodiments, or alternatively may be mounted on a fixed portion. Further, the lock bracket may be mounted to one of the fixed portion or the movable portion of the appliance or cabinet. In configuring the components of the support, the anchor and the optional lock bracket, one of the structures is likely to be connected to a fixed portion of the cabinet or appliance, if all three are used, so that the door or drawers are maintained closed and aided by the fixed portion of the appliance or cabinets. In the alternative, the support and anchor may be both be mounted to doors to maintain a closed condition or one to a fixed portion and the other to a moving portion.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A lock assembly, comprising:

a support configured to be mounted horizontally on an appliance or cabinet, said support having a plurality of pads which are spaced apart, said pads being elevated relative to a lower surface of said support;

a slide having a body which is slidably positioned relative to and engages said support and movable between a first position and a second position, constrained by said pads, said slide having a finger which moves with said slide;

a handle movable to direct movement of said slide;

an anchor having a receiving area which receives said slide to lock said slide and at least one striker surface which displaces said slide from one of said first and second positions to the other of said first and second positions before said door is closed.

2. The lock assembly of claim 1, said lock assembly configured to be mounted between at least one door and one drawer.

3. The lock assembly of claim 1, said lock assembly configured to be mounted between two drawers.

4. The lock assembly of claim 1, said lock assembly configured to be mounted between two doors.

5. The lock assembly of claim 1, said handle pivotally connected to one of said slide or said support.

6. The lock assembly of claim 1, wherein said handle disengages said slide from said anchor to open said appliance or cabinet.

7. The lock assembly of claim 1 wherein said support captures at least one of said slide and said handle.

8. The lock assembly of claim 1 further comprising a lock bracket which is engaged by said slide.

9. A lock assembly, comprising:

a support having a space for sliding movement, said support being horizontally mounted and having a plurality of pads which are spaced apart, said pads being elevated relative to a lower surface of said support;

a slide disposed adjacent to and which engages said support, said slide movable between a first position and a second position relative to said support, said slide constrained by said pads, said slide having a finger which moves with said slide;

a finger extending from said slide and capable of engaging a lock bracket in one of said first or second positions, and disengaging said lock bracket in the other of said first or second positions;

a handle which captures said slide against said support, said handle pivotally mounted to said support to move said slide linearly between said first position and said second position;

an anchor disposed opposite said support for engagement with said slide to move said slide upon engagement therewith.

10. The lock assembly of claim 9, said anchor having at least one angled surface to engage said slide and move said slide to an unlocked position.

11. The lock assembly of claim 10, said handle having a first engaging part and said slide having a second engaging part which engages said first engaging part.

12. The lock assembly of claim 11, wherein said first engaging part is one of a male part or a female part and said second engaging part is the other of a male part or a female part.

13. The lock assembly of claim 12 wherein said male and female parts have an interference engagement to move beyond a preselected position.

14. The lock assembly of claim 9, said handle having an indicator for an unlocked condition and an indicator for a locked condition.

15. The lock assembly of claim 9, said support positioned below at least one of said slide and said handle.

16. The lock assembly of claim 9 further comprising a lock bracket positioned adjacent to a path of said slide.

17. The lock assembly of claim 16 wherein said lock bracket is disposed on a fixed portion of an appliance.

18. The lock assembly of claim 16 wherein said anchor is disposed on a movable portion of said appliance.

19. The lock assembly of claim 9, wherein said support is mounted to one of a movable portion or a fixed portion of said appliance.

20. The lock assembly of claim 19, wherein said anchor is mounted to said movable portion of said appliance.

21. The lock assembly of claim 20 further comprising a lock bracket which is mounted to said one of said fixed portion or said movable portion of said appliance.

22. A lock assembly, comprising:

a support configured to be horizontally mounted on an appliance or cabinet, said support having a plurality of pads which are spaced apart, said pads being elevated relative to a lower surface of said support;

a slide having a body which is slidably engaging said support and movable between a first position and a second position constrained by said pads, said slide having a finger which moves with said slide;

a handle connected to said support and movably engaging said slide to direct movement of said slide;

an anchor having a receiving area which receives said slide to lock said slide and at least one striker surface which displaces said slide from one of said first and second positions to the other of said first and second positions before said door is closed; and, a lock bracket which receives a finger extending from said support.

* * * * *